US010309423B2

(12) United States Patent
Arenella et al.

(10) Patent No.: US 10,309,423 B2
(45) Date of Patent: Jun. 4, 2019

(54) MECHANICALLY ACTUATED SAFETY COMPLIANT FAN FINGER GUARD STRUCTURES AND METHODS

(71) Applicant: International Business Machines Corporation, Armonk, NY (US)

(72) Inventors: Kenneth Arenella, Wappingers Falls, NY (US); Levi A. Campbell, Poughkeepsie, NY (US); Christopher R. Ciraulo, Wappingers Falls, NY (US); John J. Loparco, Poughkeepsie, NY (US); Robert K. Mullady, Highland, NY (US); Budy D. Notohardjono, Poughkeepsie, NY (US); Arkadiy O. Tsfasman, Wappingers Falls, NY (US); John S. Werner, Putnam Valley, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 174 days.

(21) Appl. No.: 15/611,921

(22) Filed: Jun. 2, 2017

(65) Prior Publication Data

US 2018/0347594 A1 Dec. 6, 2018

(51) Int. Cl.

| | |
|---|---|
| ***F04D 29/00*** | (2006.01) |
| ***F04D 29/70*** | (2006.01) |
| ***F04D 19/00*** | (2006.01) |

(52) U.S. Cl.

CPC ..... *F04D 29/703* (2013.01); *F04D 19/002* (2013.01)

(58) Field of Classification Search

CPC ..... F04D 29/703

(Continued)

(56) References Cited

U.S. PATENT DOCUMENTS 4,120,615 A 10/1978 Keem et al.
5,460,571 A * 10/1995 Kato ..... F04D 29/703 361/695

(Continued)

FOREIGN PATENT DOCUMENTS

EP 0 611 924 A1 8/1994
JP 1-314834 12/1989

(Continued)

OTHER PUBLICATIONS

List of IBM Patents or Patent Applications Treated as Related dated Jun. 2, 2017, 2 pages.

(Continued)

*Primary Examiner* — Hieu T Vo
*Assistant Examiner* — Sherman D Manley
(74) *Attorney, Agent, or Firm* — Scully, Scott, Murphy & Presser, P.C.; Tihon Poltavets

(57) ABSTRACT

A fan guard and method of use thereof. The fan guard includes a first lattice, the first lattice comprising a first lattice protrusion, a second lattice, the second lattice comprising a second lattice protrusion and an inclined portion, a catch, a tensioning element, a first end of the tensioning element operably attached to the first lattice protrusion, a second end of the tensioning element operably attached to the second lattice protrusion, the tensioning element applying a rotational force to the second lattice in a first direction, a bezel, the bezel including a bezel extension that extends substantially perpendicularly from a face of the bezel, wherein the bezel extension is configured to rotate the catch and an inclined plane extending from the face of the bezel.

20 Claims, 20 Drawing Sheets

(58) Field of Classification Search
USPC ..... 415/121.2
See application file for complete search history.

(56) References Cited

U.S. PATENT DOCUMENTS

| | | | | |
|---|---|---|---|---|
| 6,042,348 | A | 3/2000 | Aakalu et al. | |
| 6,406,257 | B1 | 6/2002 | Houdek | |
| 6,503,060 | B1 * | 1/2003 | Kamada | F04D 29/703 415/121.2 |
| 6,775,137 | B2 | 8/2004 | Chu et al. | |
| 7,118,333 | B2 * | 10/2006 | Takemoto | F04D 29/703 415/211.2 |
| 7,667,966 | B2 | 2/2010 | Ong et al. | |
| 8,066,559 | B2 | 11/2011 | Cochrane | |
| 8,093,851 | B2 | 1/2012 | Yang et al. | |
| 8,388,423 | B2 | 3/2013 | Cruz et al. | |
| 8,936,443 | B2 | 1/2015 | Mashak et al. | |
| 9,137,930 | B2 | 9/2015 | Alshinnawi et al. | |
| 9,157,536 | B2 | 10/2015 | Li | |
| 9,383,117 | B2 | 7/2016 | Labrecque | |
| 2004/0197189 | A1 * | 10/2004 | Seo | F04D 29/703 415/121.2 |
| 2005/0095121 | A1 * | 5/2005 | Vithani | F04D 29/626 415/121.2 |
| 2005/0168942 | A1 | 8/2005 | Steinbrecher et al. | |
| 2010/0244759 | A1 | 9/2010 | Makley et al. | |
| 2014/0187139 | A1 * | 7/2014 | Zhong | F24F 13/14 454/207 |
| 2015/0192219 | A1 * | 7/2015 | Anderl | F16K 31/086 251/65 |
| 2016/0095260 | A1 | 3/2016 | Campbell et al. | |
| 2016/0105996 | A1 * | 4/2016 | Schanzenbach | B01D 46/0005 415/121.2 |
| 2016/0146223 | A1 | 5/2016 | Cao et al. | |
| 2016/0356172 | A1 | 12/2016 | DiVincenzo et al. | |
| 2018/0347594 | A1 | 12/2018 | Arenella et al. | |

FOREIGN PATENT DOCUMENTS

| | | | |
|---|---|---|---|
| JP | 4-203724 | | 7/1992 |
| JP | 7-122870 | | 5/1995 |
| JP | 7-324787 | | 12/1995 |
| JP | 8-162790 | | 6/1996 |
| WO | 03/042544 | A1 | 5/2003 |
| WO | 2010/048730 | A2 | 5/2010 |

OTHER PUBLICATIONS

Disclosed Anonymously, "Fan Guard Waiver", IPCOM000232276D, (3 pages) (Oct. 30, 2013).

Disclosed Anonymously, "Methods and Apparatus for Optimum Fan Operation While Maintaining High Safety Requirements", IPCOM000229498D, (5 pages) (Aug. 1, 2013).

U.S. Notice of Allowance dated Dec. 27, 2018 received in related U.S. Appl. No. 15/611,883.

* cited by examiner

MECHANICALLY ACTUATED SAFETY COMPLIANT FAN FINGER GUARD STRUCTURES AND METHODS

BACKGROUND

The present application relates to guard structures, and more particularly to a guard structure that complies with safety features and guards a fan.

Fans are used in conjunction with various electrical equipment that benefit from the movement of heat and/or air from their location. Perforations to cover the fan, thereby preventing a person from having their clothing or a portion of their bodies contact the blades of the fan, are a safety requirement. The specified dimensions for the size of perforations or openings are found in safety standards, such as International Electrotechnical Commission (IEC) 60950.

These safety standards include size of opening requirements for fan enclosures, which cover one or more surfaces of a fan.

During operation, fan enclosures with larger openings increase airflow and increase the ability of the fan to disperse heat because less material is blocking air flow from the fan. But, there is a limit as to how large the openings can be so as to still satisfy the safety requirements.

Thus, a guard structure for a fan that is safety compliant and also allows for increased air flow when the fan is in use is desired.

SUMMARY

In one embodiment, a fan guard is provided. The fan guard includes a first lattice, the first lattice comprising a first lattice protrusion, a second lattice, the second lattice comprising a second lattice protrusion and an inclined portion, a catch, a tensioning element, a first end of the tensioning element operably attached to the first lattice protrusion, a second end of the tensioning element operably attached to the second lattice protrusion, the tensioning element applying a rotational force to the second lattice in a first direction, and a bezel. The bezel includes a bezel extension that extends substantially perpendicularly from a face of the bezel, wherein the bezel extension is configured to rotate the catch and an inclined plane extending from the face of the bezel, the inclined plane configured to contact the inclined portion of the second lattice and configured to apply a rotational force to the second lattice in a second direction, moving the second lattice from an alternate position to a first position.

In another embodiment, a fan guard is provided. The fan guard includes a first lattice, the first lattice comprising a first lattice protrusion, a second lattice, the second lattice comprising a second lattice protrusion and a second lattice projection, a catch, a tensioning element, a first end of the tensioning element operably attached to the first lattice protrusion, a second end of the tensioning element operably attached to the second lattice protrusion, the tensioning element applying a rotational force to the second lattice in a first direction, a scissor arm, a first end of the scissor arm operably attached to the first lattice, a second end of the scissor arm operably attached to the second lattice projection, and a bezel. The bezel includes a first bezel extension that extends substantially perpendicularly from a face of the bezel, wherein the first bezel extension is configured to rotate the catch, and a second bezel extension that extends substantially perpendicularly from the face of the bezel, wherein the second bezel extension is configured to contact and rotate an angled portion of the scissor arm to apply a rotational force to the second lattice in a second direction moving the second lattice from an alternate position to a first position.

DETAILED DESCRIPTION

Figure 1:
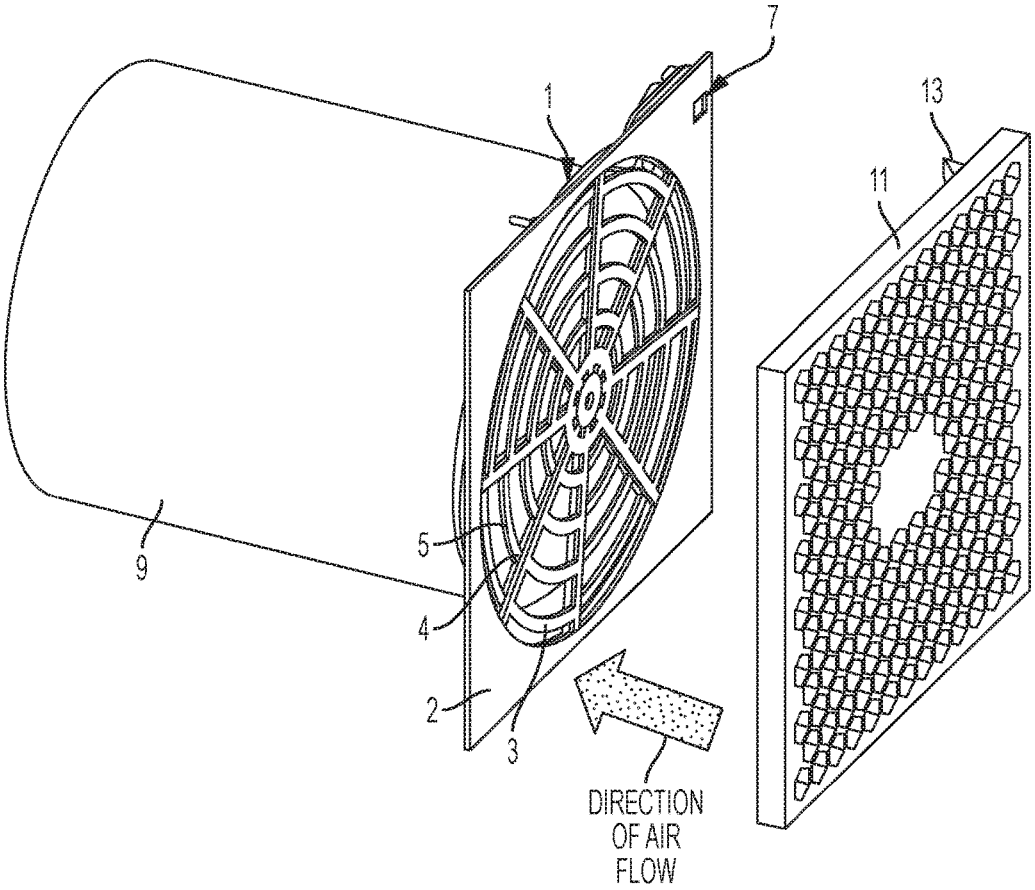
FIG. 1 is a front view of a fan guard of an embodiment of the application, in a first configuration.

The present application will now be described in greater detail by referring to the following discussion and drawings that accompany the present application. It is noted that the drawings of the present application are provided for illustrative purposes only and, as such, the drawings are not drawn to scale. It is also noted that like and corresponding elements are referred to by like reference numerals.

In the following description, numerous specific details are set forth, such as particular structures, components, materials, dimensions, processing steps and techniques, in order to provide an understanding of the various embodiments of the present application. However, it will be appreciated by one of ordinary skill in the art that the various embodiments of the present application may be practiced without these specific details. In other instances, well-known structures or processing steps have not been described in detail in order to avoid obscuring the present application.

It will be understood that when an element as a layer, region or substrate is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "beneath" or "under" another element, it can be directly beneath or under the other element, or intervening elements may be present. In contrast, when an element is referred to as being "directly beneath" or "directly under" another element, there are no intervening elements present.

In the discussion and claims herein, the term "about" indicates that the value listed may be somewhat altered, as long as the alteration does not result in nonconformance of the process or structure to the illustrated embodiment. For example, for some elements the term "about" can refer to a variation of ±0.1%, for other elements, the term "about" can refer to a variation of ±1% or ±10%, or any point therein.

As used herein, the term "substantially", or "substantial", is equally applicable when used in a negative connotation to refer to the complete or near complete lack of an action, characteristic, property, state, structure, item, or result. For example, a surface that is "substantially" flat would either be completely flat, or so nearly flat that the effect would be the same as if it were completely flat.

As used herein terms such as "a", "an" and "the" are not intended to refer to only a singular entity, but include the general class of which a specific example may be used for illustration.

As used herein, terms defined in the singular are intended to include those terms defined in the plural and vice versa.

Reference herein to any numerical range expressly includes each numerical value (including fractional numbers and whole numbers) encompassed by that range. To illustrate, reference herein to a range of "at least 50" or "at least about 50" includes whole numbers of 50, 51, 52, 53, 54, 55, 56, 57, 58, 59, 60, etc., and fractional numbers 50.1, 50.2 50.3, 50.4, 50.5, 50.6, 50.7, 50.8, 50.9, etc. In a further illustration, reference herein to a range of "less than 50" or "less than about 50" includes whole numbers 49, 48, 47, 46, 45, 44, 43, 42, 41, 40, etc., and fractional numbers 49.9, 49.8, 49.7, 49.6, 49.5, 49.4, 49.3, 49.2, 49.1, 49.0, etc. In yet another illustration, reference herein to a range of from "5 to 10" includes whole numbers of 5, 6, 7, 8, 9, and 10, and fractional numbers 5.1, 5.2, 5.3, 5.4, 5.5, 5.6, 5.7, 5.8, 5.9, etc.

As used herein the term "lattice" is used in a broad sense to refer to a mesh-like structure having one or more elements that extend across a frame to form smaller openings, such as in a grate, a grid, a grill or a web of elements.

Referring first to FIG. 1, there is illustrated a general, perspective, front view of one embodiment of a fan apparatus, the fan apparatus including a fan guard 1, a circular fan housing 9 and a bezel 11 that separates users from the fan guard 1 and a fan within fan housing 9. The fan guard 1 includes a first lattice 2 and a second lattice 4. First lattice 2 includes a number of first crosspieces 3, in an annular pattern in this embodiment. Second lattice 4 includes a number of second crosspieces 5, in an annular pattern in this embodiment. In other embodiments, the first crosspieces 3 and second crosspieces 5 can be the same, or different, and can be in any pattern that is suitable for the flow of air therethrough. The fan guard 1 can be placed in any suitable frame or structure to maintain the position of the fan guard 1 between a user and a rotating fan shaft (with blades attached thereto) within the fan housing 9.

In this embodiment, the pattern of first crosspieces 3 and second crosspieces 5 remains substantially the same in the four separate portions containing the crosspieces across the first lattice 2 and second lattice 4. In other embodiments, the pattern of first crosspieces 3 and second crosspieces 5 can change, such as by having a larger or smaller opening or a thicker or thinner crosspiece, as the distance increases from a center of the fan guard 1.

The first lattice 2 and the second lattice 4 can be formed of the same, or different materials from each other. These materials can be any suitable material that can maintain a structural form, such as plastics, metals, carbon based materials, and mixtures thereof.

In this embodiment the bezel 11 is shown as having a honeycomb pattern of openings, but in other embodiments, bezel 11 can include any pattern that is suitable for the flow of air therethrough. Bezel 11 also includes a bezel extension 13 (further discussed and shown in the following figures) that extends substantially perpendicularly from the rear of bezel 11I and through an opening 7 in the first lattice 2.

When the bezel 11 is removed, the second lattice 4 is in the alternate position, as seen in FIG. 1. Openings between both the first crosspieces 3 and openings between the second crosspieces 5 are smaller than or equal to the area proscribed in safety standards, such as IEC 60950, so as to not allow a person's finger to pass through both the first lattice 2 and the second lattice 4 to contact moving fan blades within fan housing 9. In other embodiments the area of one or both of the first lattice 2 and the second lattice 4 near the center of fan guard 1 can include a different pattern of crosspieces, resulting in larger openings, or can be substantially covered by a guard or plate to not allow access by a user.

Within the fan housing 9, a fan shaft and fan blades can be contained. This fan housing 9 is shown for illustrative purposes and is not limited to the size, orientation or location it is shown in. Also for illustrative purposes, an arrow is shown indicating the flow of air from the interior of the fan housing 9 towards the first lattice 2 and second lattice 4. In other embodiments, the flow of air can be in the opposite direction, or at any angle that passes air through the first lattice 2 and the second lattice 4.

Figure 2:
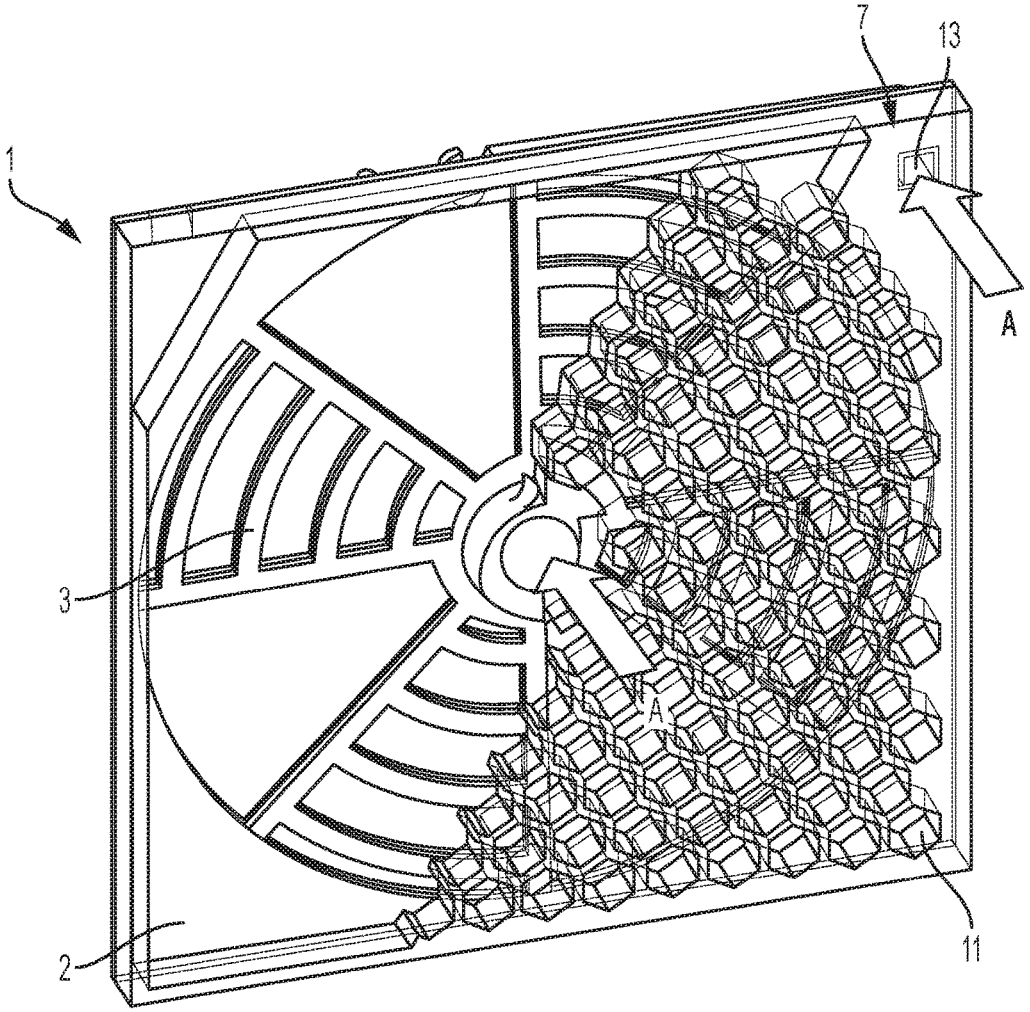
FIG. 2 is a front view of a fan guard of an embodiment of the application, in a second configuration.

Referring to FIG. 2, there is illustrated a general, front view of one embodiment of the fan guard 1. In this view, second lattice 4 has been rotated to a position directly behind the first lattice 2 and hidden from view (a first position of second lattice 4). In this view, first crosspieces 3 of the first lattice 2 substantially align with second crosspieces 5 of the second lattice 4. The bezel 11 is shown as substantially transparent, and with portions removed, for illustrative purposes. In this view, bezel 11 is moved into an operational position (further discussed in reference to figures below) by pressing the bezel 11 in the direction of arrows A. By this pressing of bezel 11, bezel extension 13 extends through the opening 7 and allows for rotation of the second lattice 4 into the configuration shown in FIG. 2.

The positional change between FIGS. 1 and 2, between the first position of the second lattice 4 and the alternate position, is shown and described as a rotational change along the X-Y axes, but in other embodiments, this positional change can be due to any rotational movement along any plane.

Further, when the second lattice 4 is in the first position, as seen in FIG. 2, the openings between both the first crosspieces 3 and openings between the second crosspieces 5 are larger than the area proscribed in safety standards such as IEC 60950, so as to allow a larger flow of air to pass through both the first lattice 2 and the second lattice 4. A user cannot touch moving fan blades in this configuration due to the bezel being installed.

Figure 3:
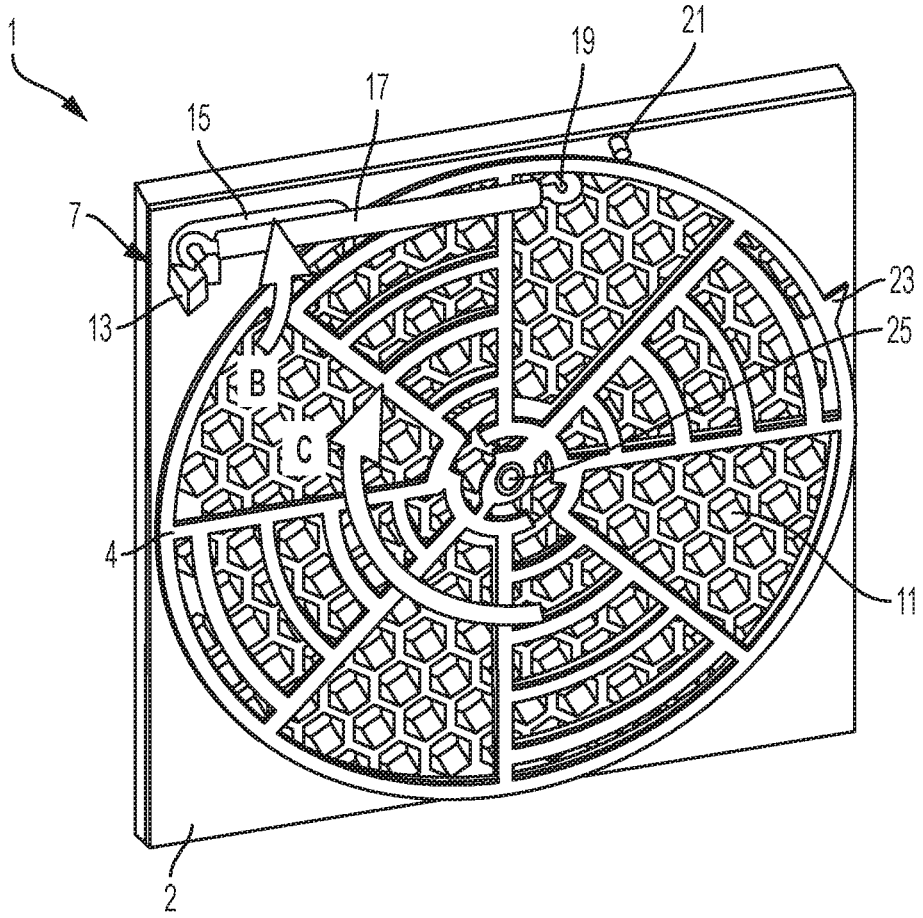
FIG. 3 is a rear view of a fan guard of an embodiment of the application, in a second configuration.

Referring to FIG. 3, there is illustrated a general, rear view of one embodiment of the fan guard 1. In this view, the second lattice 4 is in a first position, having rotated according to the direction of arrow C. Also in this view it can be seen that bezel extension 13 has extended through opening 7 and has contacted a catch 15. In some embodiments, such as that shown in FIG. 3, bezel extension 13 can include a tapered face that contacts the catch 15 and causes the catch 15 to rotate according to the direction of arrow B about a pivot (shown in more detail in FIG. 4 below). In other embodiments, bezel extension 13 can extend a shorter distance, or no distance, from the bezel 11, and can include a magnetic force that interacts with a magnetic force of the catch 15 to cause a rotation of the catch 15.

A tensioning element 17, such as a spring, is affixed to a first lattice protrusion 16 on a first end, and a second end of the tensioning element 17 can be affixed to a second lattice protrusion 19. In FIG. 3, tensioning element 17 is under tension and upon removal of bezel extension 13, will cause the second lattice 4 to rotate opposite of arrow C, into the alternate position shown in FIG. 1. Second lattice 4 is operably affixed to first lattice 2 and rotates in comparison to the first lattice 2 about a lattice pivot point 25.

Figure 5:
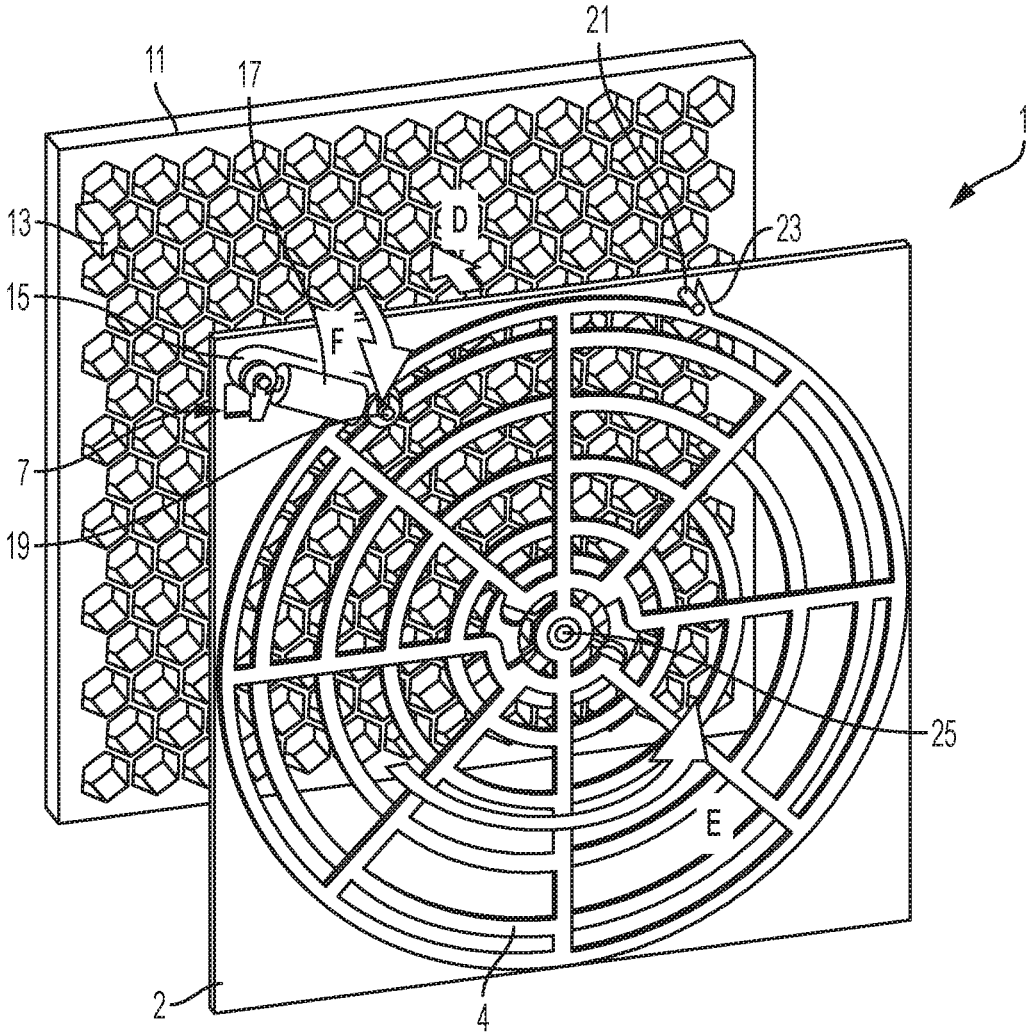
FIG. 5 is a rear view of a fan guard of an embodiment of the application in a first configuration.

A first lattice extension 21 extends from the first lattice 2, contacting a second lattice extension 23 upon rotation of second lattice 4 opposite of arrow C to stop the rotation of second lattice 4 upon removal of bezel 11, as shown in FIG. 5 below.

Figure 4:
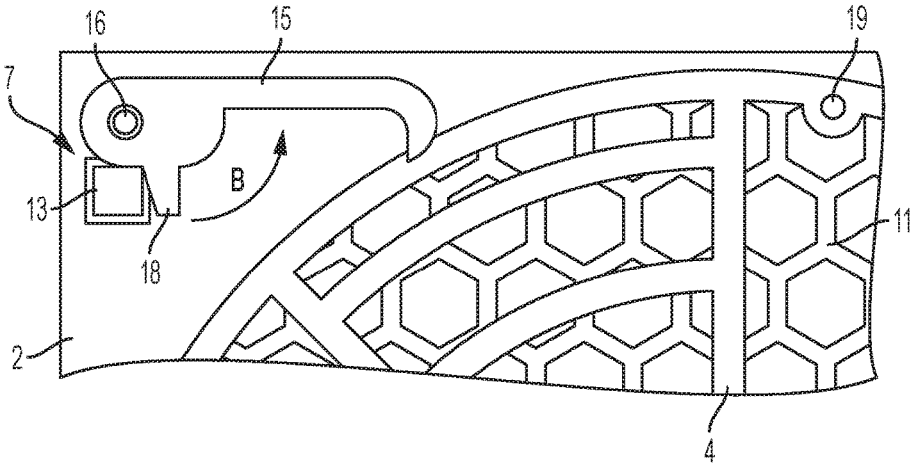
FIG. 4 is a magnified view of a portion of FIG. 3.

A detailed view of the catch 15 is shown in FIG. 4 (in the configuration shown in FIG. 3), with tensioning element 17 removed for illustrative purposes. The catch 15 rotates about the first lattice protrusion 16 in the direction of arrow B (same direction as arrow B of FIG. 3). In this embodiment the first lattice protrusion 16 is shown as a pivot point for catch 15, but in other embodiments, the first lattice protrusion 16 can be separate from the pivot point for the catch 15 and can be in a different suitable location.

Catch 15 is caused to rotate in the direction of arrow B through bezel extension 13 contacting catch receiving protrusion 18.

Referring to FIG. 5, there is illustrated a general, rear view of one embodiment of the fan guard 1, with bezel 11 moved away from fan guard 1 in the direction of arrow D. As bezel 11 moves in the direction of arrow D, the bezel extension 13 withdraws through opening 7, allowing for the catch 15 to rotate in the direction of arrow F due to the contraction of tensioning element 17.

In this view, with the second lattice 4 in the alternate position, second lattice 4 has rotated in the direction of arrow E (as compared to the view in FIG. 3) about lattice pivot point 25 due to the contraction of tensioning element 17. In the alternate position the first lattice extension 21 contacts the second lattice extension 23 and restricts further rotation of the second lattice 4.

Figure 6:
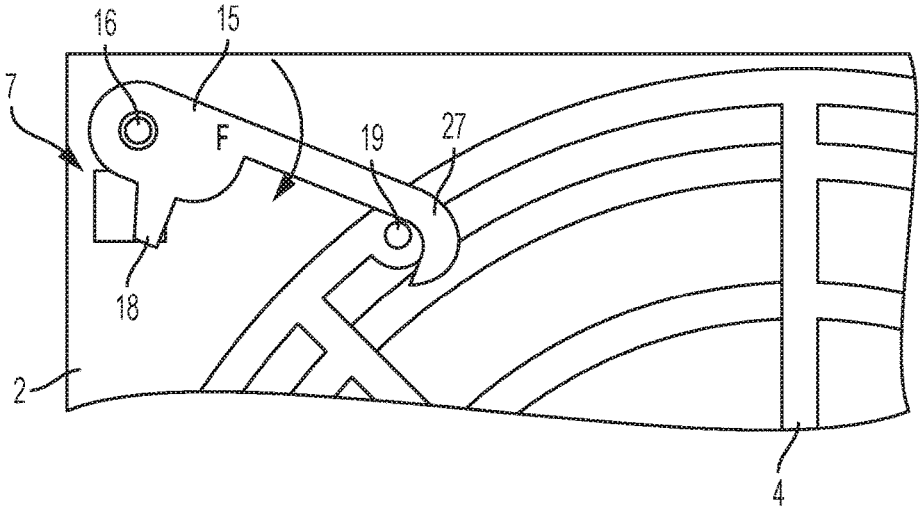
FIG. 6 is a magnified view of a portion of FIG. 5.

A detailed view of the catch 15 is shown in FIG. 6 (in the configuration shown in FIG. 5), with tensioning element 17 removed for illustrative purposes. The catch 15 rotates about the first lattice protrusion 16 in the direction of arrow F (same direction as arrow F of FIG. 5). Catch 15 is caused to rotate in the direction of arrow F due to the contraction of tensioning element 17 (shown in FIG. 5) upon removal of bezel 11. As the catch 15 rotates in the direction of arrow F, a substantially hook-shaped protrusion 27 of the catch 15 extends around at least a portion of second lattice protrusion 19. When the substantially hook-shaped protrusion 27 is in the configuration shown in FIG. 6, rotation of the second lattice 4 in a direction opposite of arrow E (of FIG. 5) via human interaction with an appendage or tool is restricted or prevented.

The operation of causing the second lattice 4 to rotate from the alternate position (shown in FIGS. 1 and 5) to the first position (shown in FIGS. 2 and 3) is discussed below beginning with FIG. 7.

Figure 7:
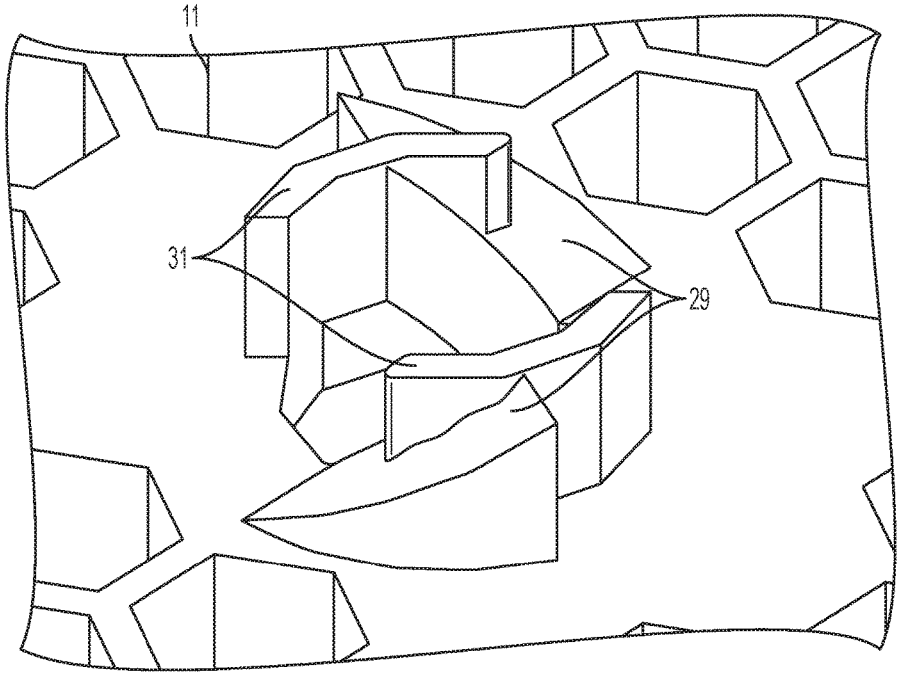
FIG. 7 is a magnified view of a rear portion of a bezel.

FIG. 7 is a magnified view of a central area of the bezel 11, specifically, the face of the bezel 11 that is in contact with the first lattice 2 in FIG. 3. In FIG. 7, the bezel 11 includes at least one (in this figure two) helical, inclined planes 29 and, optionally, at least one (in this figure two) bezel protrusions 31. The optional bezel protrusions 31 can aid in placement of the bezel 11 against the lattices (as in the direction of arrow A in FIG. 2), and can also restrict rotation of the second lattice 4, as desired.

Figure 8:
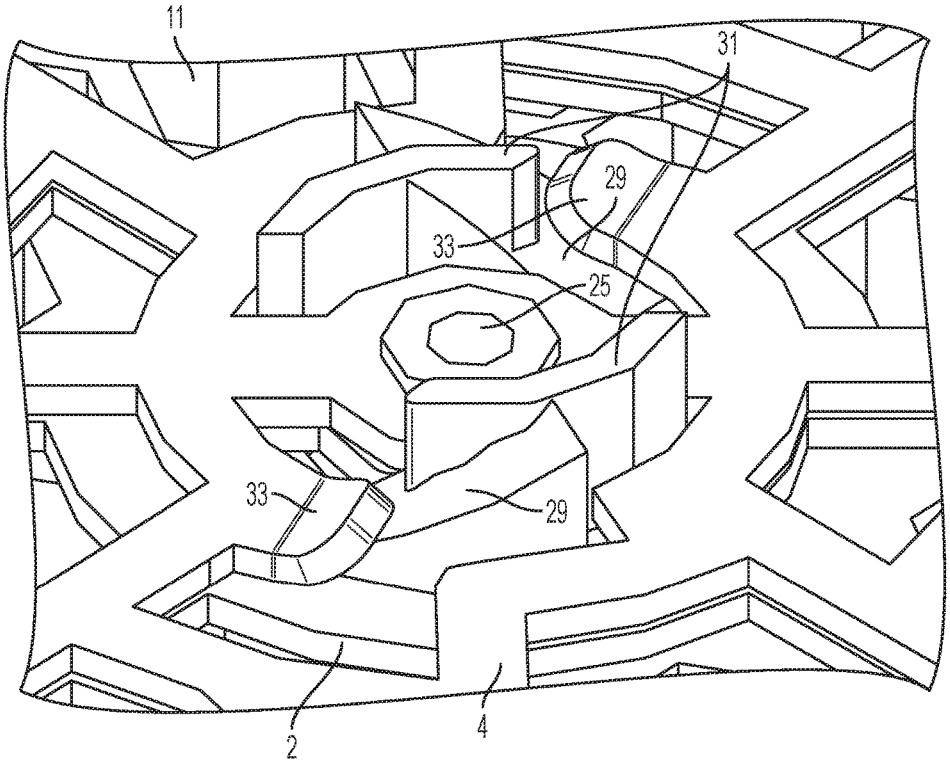
FIG. 8 is a magnified view of a rear portion of a bezel, including a first and second lattice.

FIG. 8 is a magnified view of the central area of bezel 11, illustrating the interaction of the bezel 11, first lattice 2 and second lattice 4. As can be seen in FIG. 8, the second lattice 4 includes two inclined portions 33, but in other embodiments one inclined portion can be included if one inclined plane 29 is included. As bezel 11 is moved (in the direction of arrow A of FIG. 2) the inclined planes 29 impact the inclined portions 33 and cause rotation of the second lattice 4 in a clockwise direction as shown in FIG. 8. In this embodiment the rotation is in a clockwise direction, but in other embodiments, the angle of the inclined planes 29 and inclined portions 33 can be modified for an opposite rotation.

Figure 9A:
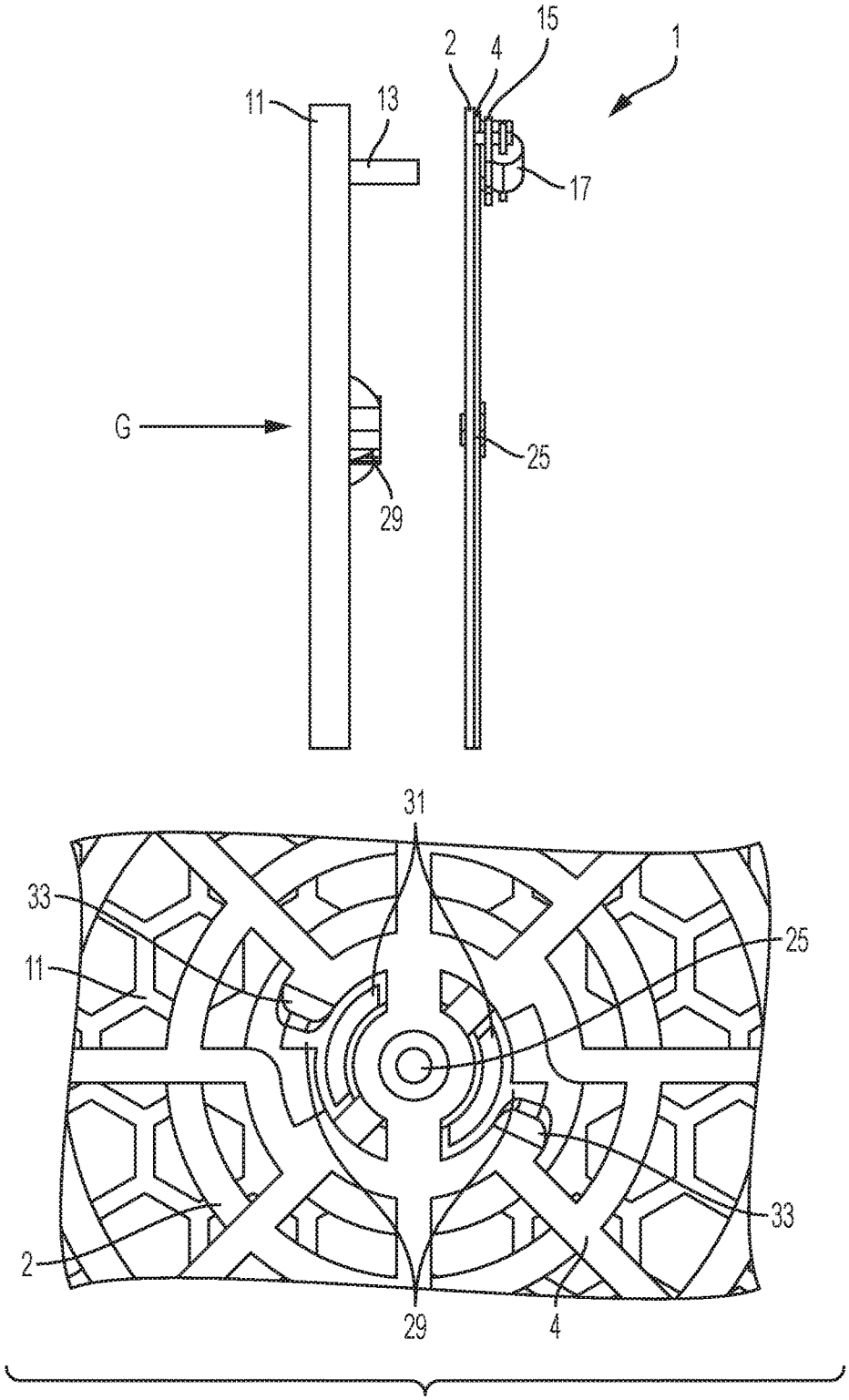
FIGS. 9A-9C are comparative side views and magnified views of a rear portion of a bezel, including a first and second lattice.
Figure 9B:
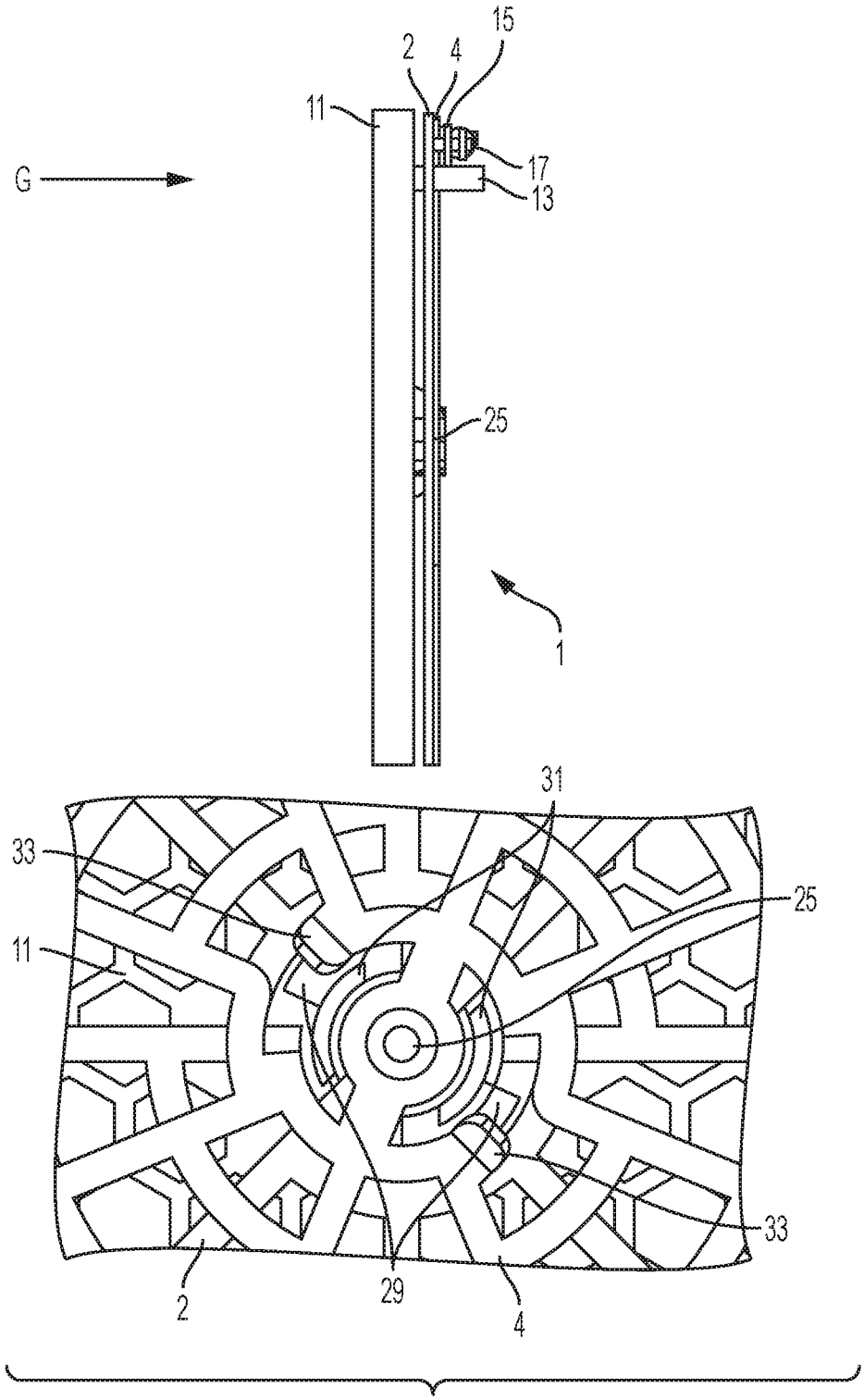
Figure 9C:
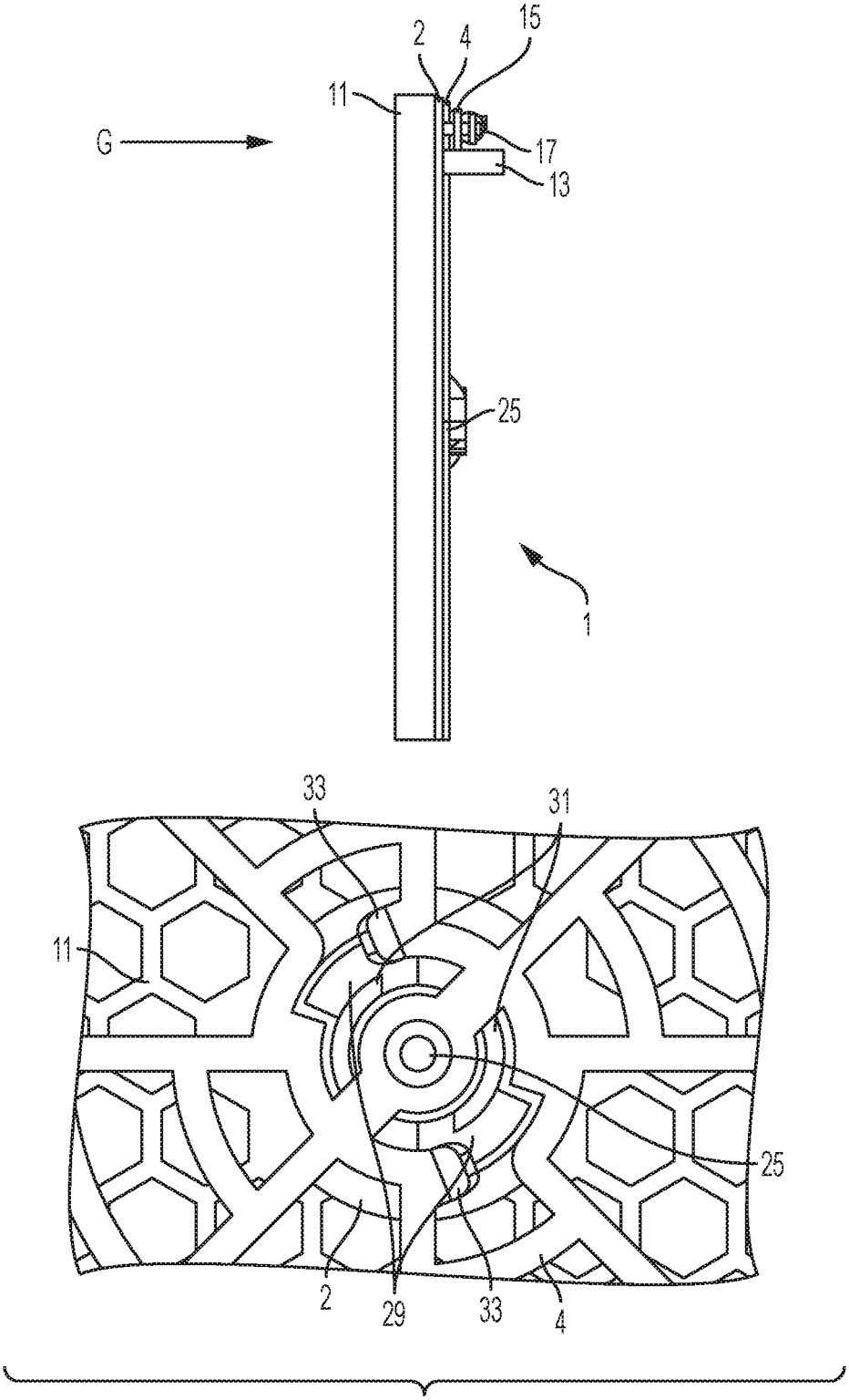

FIGS. 9A-9C illustrate a method of applying the bezel 11, and how that bezel 11 interacts with the first lattice 2 and the second lattice 4.

In FIG. 9A, the second lattice 4 is in the alternate position. As seen in the upper portion of FIG. 9A, the bezel 11 is not in place, but is now moving in the lateral direction of the arrow G towards the fan guard 1. Bezel 11 can be moved physically by a user and/or bezel 11 can be moved through a solenoid or other suitable actuator that is capable of moving bezel 11. In this configuration, the tensioning element 17 is under little or no tension (as shown in more detail in FIG. 5).

As can be seen in FIG. 9A, the bezel extension 13 extends a further distance from the bezel 11 than inclined planes 29. This difference in distance allows for the bezel extension 13 to contact the catch 15, thus disengaging the catch from the second lattice protrusion 19 prior to the inclined planes 29 contacting the inclined portions 33 of the second lattice 4.

In FIG. 9B, the second lattice 4 is transitioning between the alternate position and the first position. In this transition, the bezel extension 13 has contacted and released the catch 15, and the inclined portions 33 of the second lattice 4 begin to contact the inclined planes 29 of bezel 11. As the bezel extension 13 contacts the catch 15, specifically the catch receiving protrusion 18, the catch 15 begins to rotate in the direction of arrow B in FIG. 4. As the bezel 11 moves further in the direction of arrow G, the inclined portions 33 further contact the inclined planes 29, causing the second lattice 4 to rotate in a clockwise direction. This linear motion of bezel 11, in the direction of the arrow, is translated to a rotational movement of the second lattice 4 through contact of the inclined portions 33 and the inclined planes 29.

In this configuration, the tensioning element 17 begins to receive tension by the rotation of the second lattice 4.

In FIG. 9C, the second lattice 4 has been moved to the first position. In this configuration, the tensioning element 17 is under tension (as shown in more detail in FIG. 3) and the bezel 11 is contacting (or is in close proximity to) the first lattice 2. In this configuration portions of the second lattice 4 can come into rotational contact with the bezel protrusions 31, which can provide a further mechanism to stop the rotation of the second lattice 4 at the first position.

Figure 10:
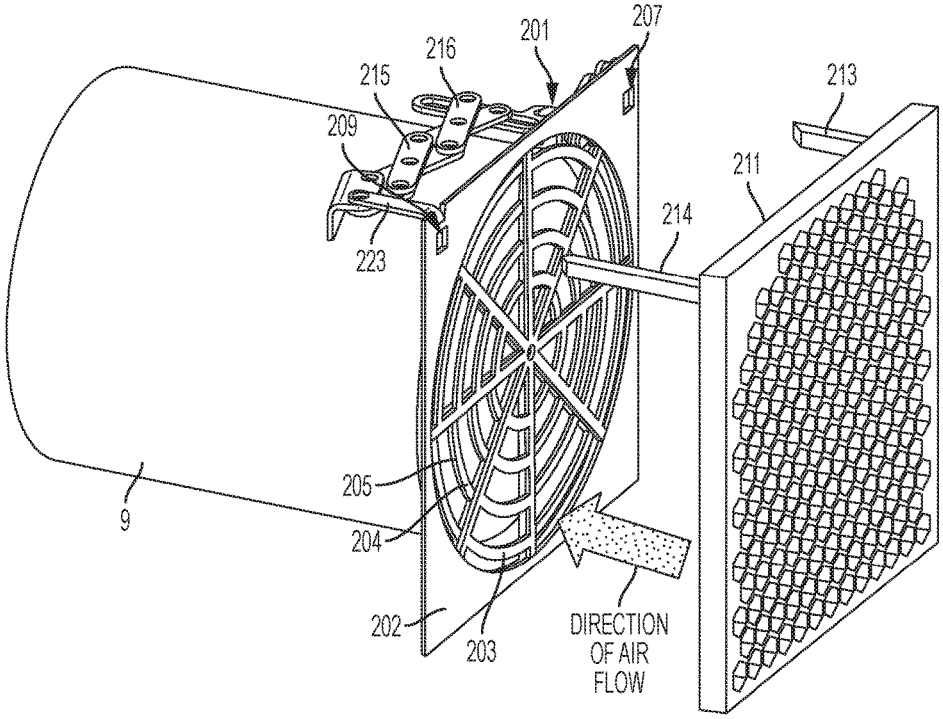
FIG. 10 is a front view of a fan guard of an embodiment of the application, in a first configuration.

Referring first to FIG. 10, there is illustrated a general, perspective, front view of another embodiment of a fan apparatus, the fan apparatus including a fan guard 201, a circular fan housing 9 and a bezel 211 that separates users from the fan guard 201 and a fan within fan housing 9. The fan guard 201 includes a first lattice 202 and a second lattice 204. First lattice 202 includes a number or first crosspieces 203, in an annular pattern in this embodiment. Second lattice 204 includes a number of second crosspieces 205, in an annular pattern in this embodiment. In other embodiments, the first crosspieces 203 and second crosspieces 205 can be the same, or different, and can be in any pattern that is suitable for the flow of air therethrough. The fan guard 201 can be placed in any suitable frame or structure to maintain the position of the fan guard 201 between a user and a rotating fan shaft (with blades attached thereto) within the fan housing 9.

In this embodiment, the pattern of first crosspieces 203 and second crosspieces 205 remains substantially the same in the four separate portions containing the crosspieces across the first lattice 202 and second lattice 204. In other embodiments, the pattern of first crosspieces 203 and second crosspieces 205 can change, such as by having a larger or smaller opening or a thicker or thinner crosspiece, as the distance increases from a center of the fan guard 201.

Figure 11:
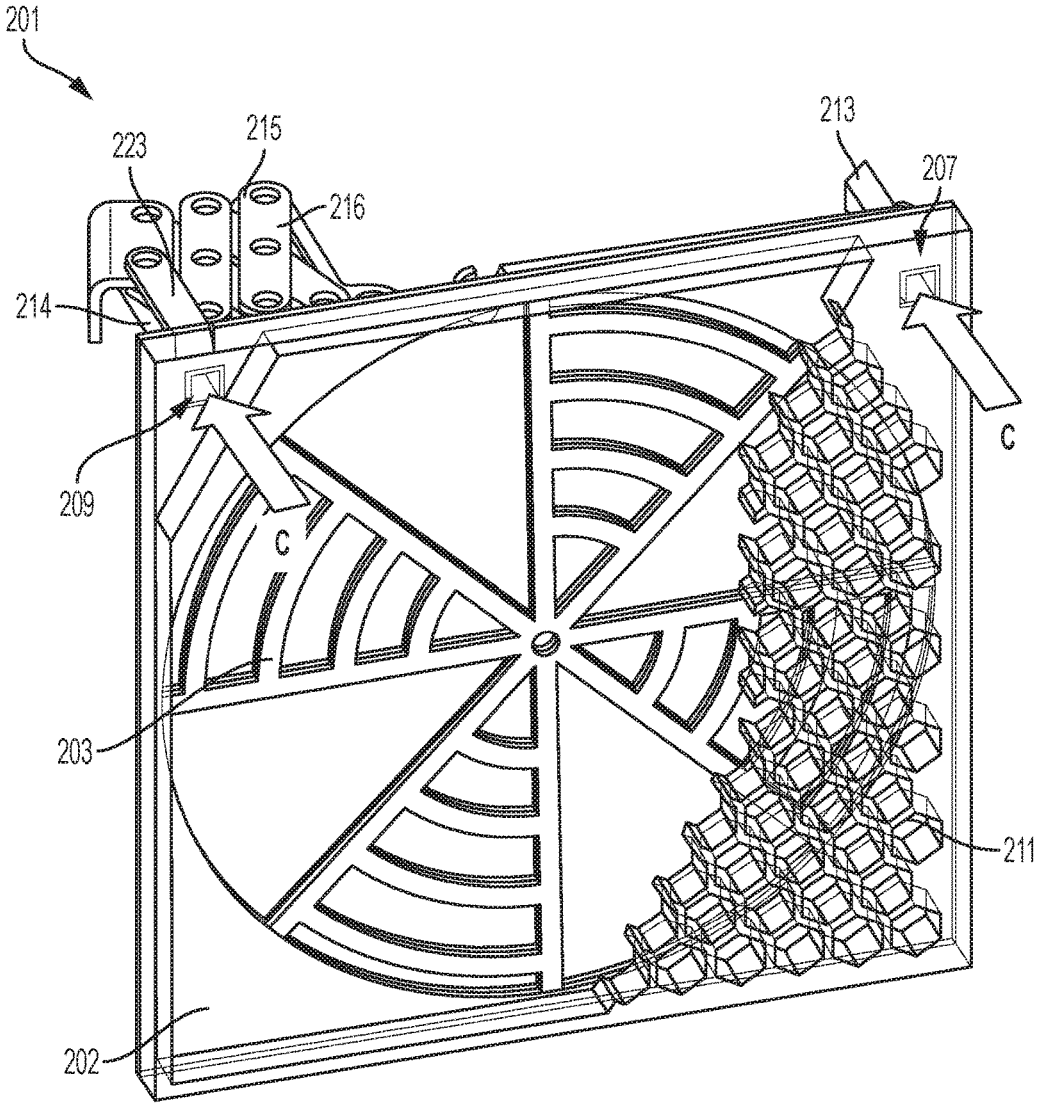
FIG. 11 is a front view of a fan guard of an embodiment of the application, in a second configuration.

In this embodiment a scissor arm 215 extends from a first lattice extension 223 to operably connect to the second lattice 204, which is shown more fully below. The scissor arm 215 is comprised of a plurality of operably connected links 216 that can rotate in reference to one another and in reference to the fan guard 201. When the second lattice 204 is in an alternate position (as shown in FIG. 10), the scissor arm 215 is extended, as shown in FIG. 10. When the second lattice 204 is in a first position (as shown in FIG. 11), the scissor arm 215 is retracted.

The first lattice 202 and the second lattice 204 can be formed of the same, or different materials from each other. These materials can be any suitable material that can maintain a structural form, such as plastics, metals, carbon based materials, and mixtures thereof.

In this embodiment the bezel 211 is shown as having a honeycomb pattern of openings, but in other embodiments, bezel 211 can include any pattern that is suitable for the flow of air therethrough. Bezel 211 also includes a first bezel extension 213 (further discussed and shown in the following figures) that extends substantially perpendicularly from the rear of bezel 211 and through a first opening 207 in the first lattice 202. Bezel 211 also includes a second bezel extension 214 (further discussed and shown in the following figures) that extends substantially perpendicularly from the rear of bezel 211 and through a second opening 209 in the first lattice 202.

When the bezel 211 is removed, the second lattice 204 is in the alternate position, as seen in FIG. 10. Openings between both the first crosspieces 203 and openings between the second crosspieces 205 are smaller than or equal to the area proscribed in safety standards, such as IEC 60950, so as to not allow a person's finger to pass through both the first lattice 202 and the second lattice 204 to contact moving fan blades within fan housing 9. In other embodiments the area of one or both of the first lattice 202 and the second lattice 204 near the center of fan guard 201 can include a different pattern of crosspieces, resulting in larger openings, or can be substantially covered by a guard or plate to not allow access by a user.

Within the fan housing 9, a fan shaft and fan blades can be contained. This fan housing 9 is shown for illustrative purposes and is not limited to the size, orientation or location it is shown in. Also for illustrative purposes an arrow indicating the flow of air from the interior of the fan housing 9 towards the first lattice 202 and second lattice 204. In other embodiments, the flow of air can be in the opposite direction, or at any angle that passes air through the first lattice 202 and the second lattice 204.

Referring to FIG. 11, there is illustrated a general, front view of one embodiment of the fan guard 201. In this view, second lattice 204 has been rotated to a position directly behind the first lattice 202 and hidden from view (a first position of the second lattice 204). In this view, first crosspieces 203 of the first lattice 202 substantially align with second crosspieces 205 of the second lattice 204. The bezel 211 is shown as substantially transparent, and with portions removed, for illustrative purposes. In this view, bezel 211 is moved into an operational position (further discussed in reference to figures below) by pressing the bezel 211 in the direction of arrows C. This pressing of bezel 211 causes first bezel extension 213 to extend through the first opening 207 and allows for rotation of the second lattice 204 into the configuration shown in FIG. 11. This pressing of bezel 211 also causes the second bezel extension 214 to extend through the second opening 209 and contact a portion of scissor arm 215, rotating the second lattice 204 into the configuration shown in FIG. 11.

The positional change between FIGS. 10 and 11, between the first position and the alternate position, is shown and described as a rotational change along the X-Y axes, but in other embodiments, this positional change can be due to any rotational movement along any plane.

Further, when the second lattice 204 is in the first position, as seen in FIG. 11, the openings between both the first crosspieces 203 and openings between the second crosspieces 205 are larger than the area proscribed in safety standards such as IEC 60950, so as to allow a larger flow of air to pass through both the first lattice 202 and the second lattice 204. A user cannot touch moving fan blades in this configuration due to the bezel being installed.

Figure 12:
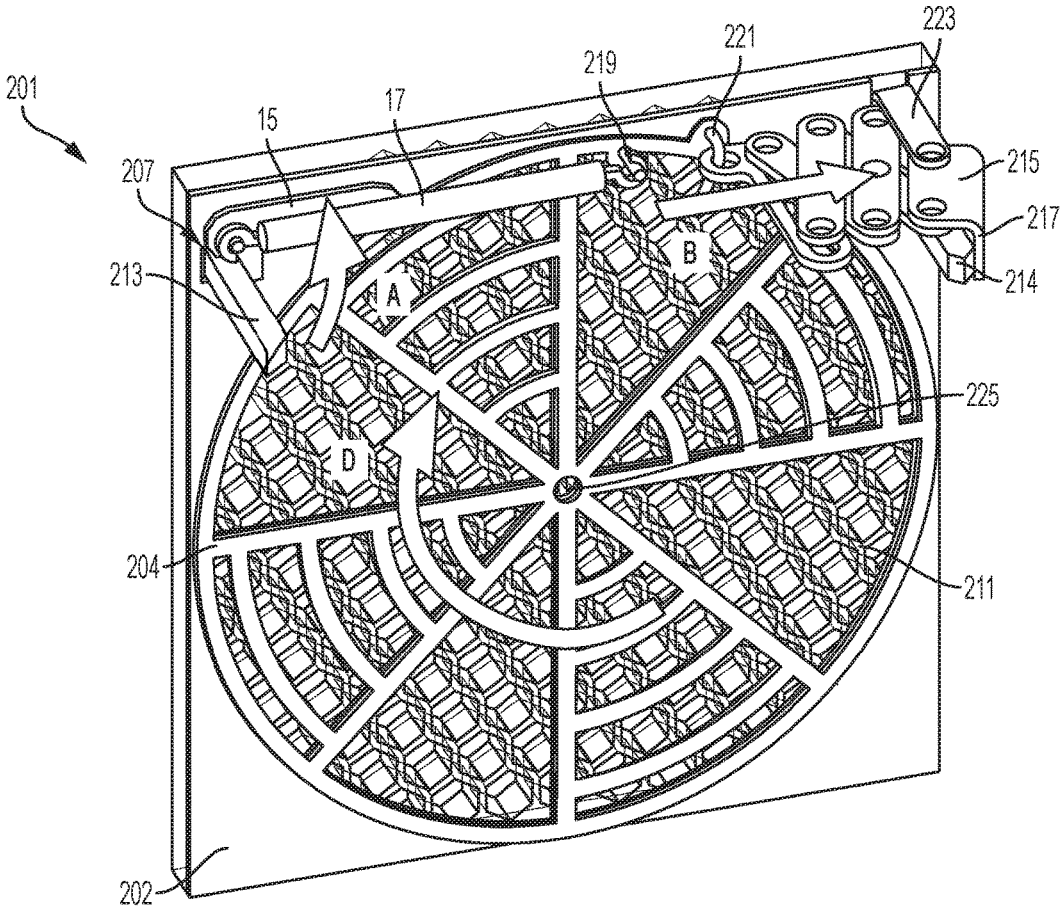
FIG. 12 is a rear view of a fan guard of an embodiment of the application, in a second configuration.

Referring to FIG. 12, there is illustrated a general, rear view of one embodiment of the fan guard 201. In this view, the second lattice 204 is in a first position, having rotated according to the direction of arrow D. Also in this view it can be seen that first bezel extension 213 has extended through the first opening 207 and has contacted a catch 15. In some embodiments, such as that shown in FIG. 12, first bezel extension 213 can include a tapered face that contacts the catch 15 and causes the catch 15 to rotate according to the direction of arrow A about a pivot (shown in more detail in FIG. 13 below).

Also in this view, it can be seen that the second bezel extension 214 has extended through the second opening 209 and has contacted a portion of the scissor arm 215. In some embodiments, such as that shown in FIG. 12, the second bezel extension 214 can include a tapered face that contacts an angled portion 217 of the scissor arm 215 and causes the scissor arm 215 to retract in the direction of arrow B. The scissor arm is operably connected on a first end to the first lattice extension 223 and operably connected on a second end to a second lattice projection 221.

A tensioning element 17, such as a spring, is affixed to a first lattice protrusion 16 on a first end, and a second end of the tensioning element 17 can be affixed to a second lattice protrusion 219. In FIG. 12, tensioning element 17 is under tension, and upon removal of first bezel extension 213, will cause the second lattice 204 to rotate opposite of arrow D, into the alternate position shown in FIG. 10. Second lattice 204 is operably affixed to first lattice 202 and rotates in comparison to the first lattice 202 about a lattice pivot point 225.

Figure 13:
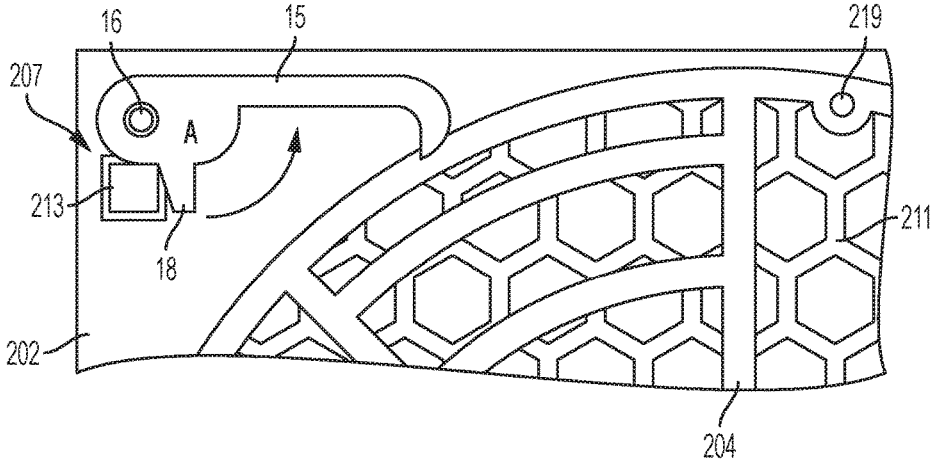
FIG. 13 is a magnified view of a portion of FIG. 12.

A detailed view of the catch 15 is shown in FIG. 13 (in the configuration shown in FIG. 12), with tensioning element 17 removed for illustrative purposes. The catch 15 rotates about first lattice protrusion 16 in the direction of arrow A (same direction as arrow A of FIG. 12). In this embodiment the first lattice protrusion 16 is shown as a pivot point for catch 15, but in other embodiments, the first lattice protrusion 16 can be separate from the pivot point for the catch 15 and can be in a different suitable location. Catch 15 is caused to rotate in the direction of arrow A through first bezel extension 213 contacting catch receiving protrusion 18.

Figure 14:
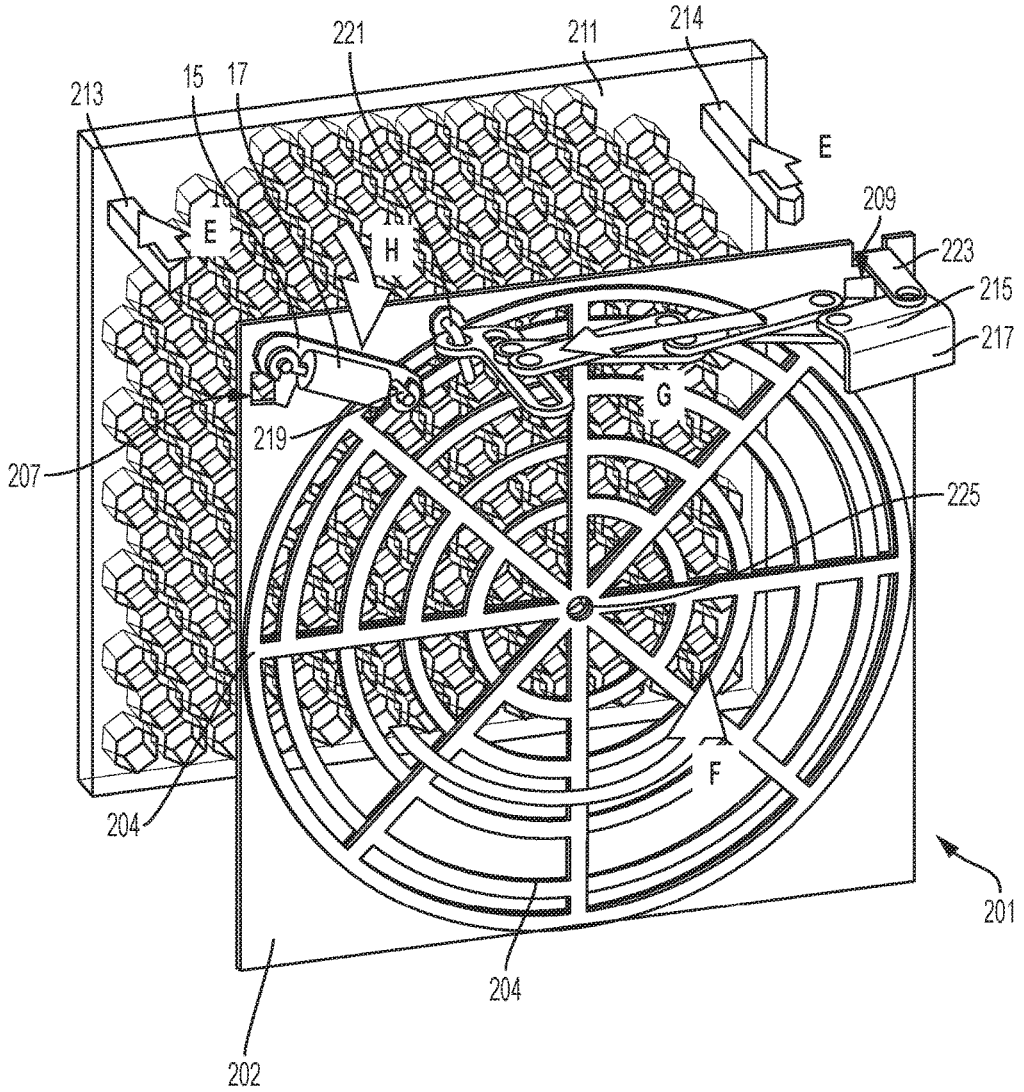
FIG. 14 is a rear view of a fan guard of an embodiment of the application in a first configuration.

Referring to FIG. 14, there is illustrated a general, rear view of one embodiment of the fan guard 1, with bezel 211 moved away from fan guard 201 in the direction of arrows E. As bezel 211 moves in the direction of arrows E, the second bezel extension 214 withdraws through the second opening 209, allowing for the scissor arm 215 to extend in the direction of arrow G due to the contraction of tensioning element 17. Subsequently, as bezel 211 continues moving in the direction of arrows E, the first bezel extension 213 withdraws through the first opening 207, allowing for the catch 15 to rotate in the direction of arrow H due to the contraction of tensioning element 17.

In this view, with the second lattice 204 in the alternate position, second lattice 204 has rotated in the direction of arrow F (as compared to the view in FIG. 12) about lattice pivot point 225. The second lattice 204 has rotated due to the contraction of tensioning element 17.

Figure 15:
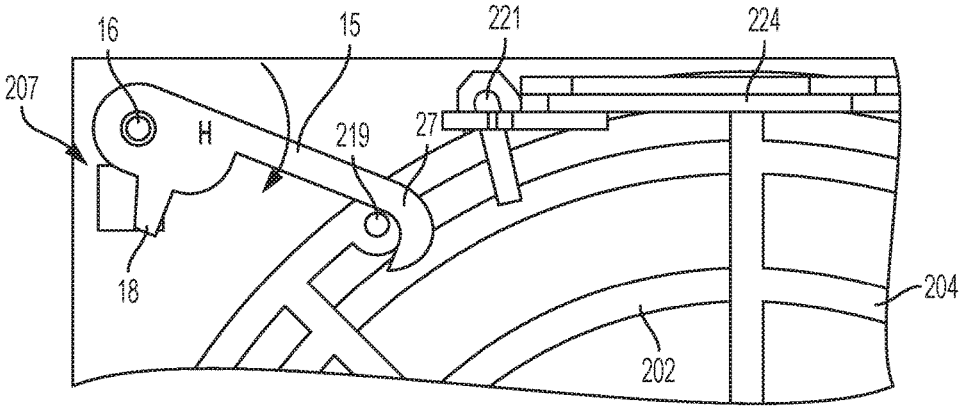
FIG. 15 is a magnified view of a portion of FIG. 14.

A detailed view of the catch 15 is shown in FIG. 15 (in the configuration shown in FIG. 14), with tensioning element 17 removed for illustrative purposes. The catch 15 rotates about the first lattice protrusion 16 in the direction of arrow H (same direction as arrow H of FIG. 14). Catch 15 is caused to rotate in the direction of arrow H due to the withdrawal of first bezel extension 213. As the catch 15 rotates in the direction of arrow H, a substantially hook shaped protrusion 27 of the catch 15 extends around at least a portion of second lattice protrusion 219. When the substantially hook shaped protrusion 27 is in the configuration shown in FIG. 15, rotation of the second lattice 204 in a direction opposite of arrow F (of FIG. 14) via human interaction with an appendage or tool is restricted or prevented.

The operation of causing the second lattice 204 to rotate from the alternate position (shown in FIGS. 10 and 14) to the first position (shown in FIGS. 11 and 12) is discussed below in conjunction with FIGS. 16A and 16B.

Figure 16A:
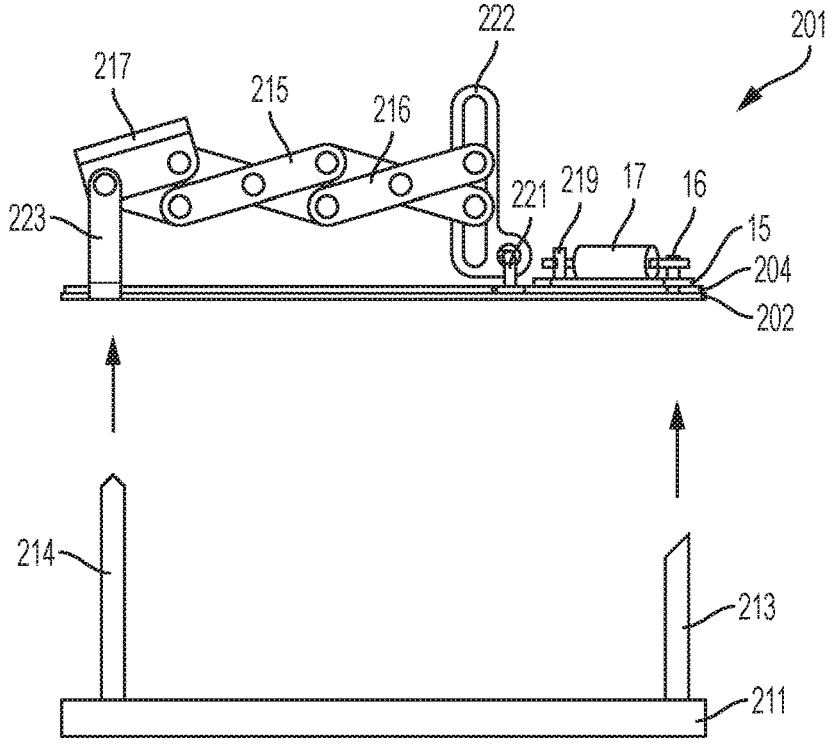
FIGS. 16A and 16B are comparative top views of an embodiment of a bezel, including a first and second lattice.

FIG. 16A is a top view of the fan guard 201 when the second lattice 204 is in the alternate position. As can be seen in FIG. 16A, in this embodiment, the angled portion 217 of scissor arm 215 is further recessed inside fan guard 201 as compared to the catch 15. Thus, first bezel extension 213 contacts and rotates catch 15 before second bezel extension 214 contacts angled portion 217 of scissor arm 215 when the bezel 211 is moving in the direction of the arrows in FIG. 16A. Also, after the bezel 211 is moved fully towards the fan guard 201 and withdrawn (opposite of arrows in FIG. 16A) the second bezel extension 214 withdraws from contacting the angled portion 217 of the scissor arm 215 prior to the first bezel extension 213 withdrawing from contacting the catch 15 (so that the substantially hook-shaped protrusion 27 engages the second lattice protrusion 219 as shown in FIG. 15).

In other embodiments the second bezel extension 214 and the first bezel extension 213 can be substantially the same length.

In this embodiment, scissor arm 215 is operably connected to the second lattice projection 221 through a connector 222. Connector 222 can be any suitable shape that can substantially translate the rotation of links 216 to a substantially tangential motion of the second lattice projection 221.

Figure 16B:
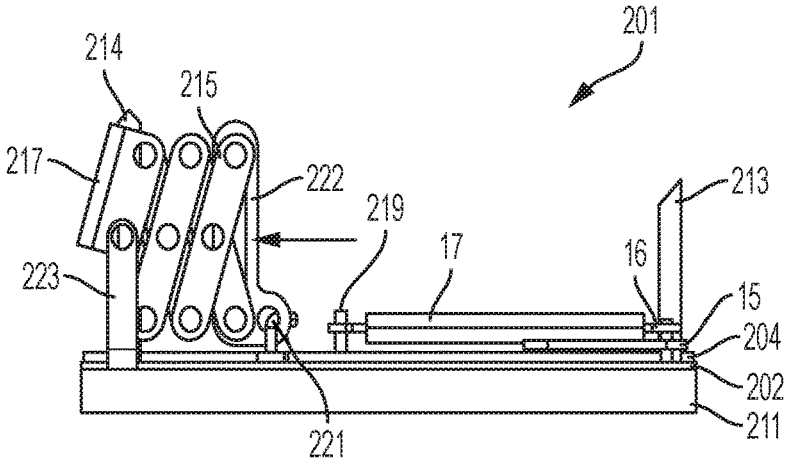

FIG. 16B is a top view of the fan guard 201 when the second lattice 204 is in the first position. In this configuration the second lattice extension 214 has contacted the angled portion 217 of the scissor arm 215 and caused the angled portion 217 of the scissor arm 215 to rotate counterclockwise, and retract scissor arm 215 in the direction of the arrow of FIG. 16B. This retraction of scissor arm 215 also causes the tensioning element 17 to expand.

The methods and devices of the present disclosure will be better understood by reference to the following examples, which are provided as exemplary of the disclosure and not by way of limitation.

Example 1

When fan guard 1 is in the alternate position, as shown in FIG. 1, the radial areas formed by the openings of both the first lattice 2 and the second lattice 4 (white areas between the crosspieces of both the first lattice 2 and the second lattice 4) combine to an open area of about 3,141 $mm^2$.

When fan guard 1 is in the first position, as shown in FIG. 3, the radial areas formed by the openings of both the first lattice 2 and the second lattice 4 (white areas between the crosspieces of the first lattice 2 and the second lattice 4) combine to an open area of about 3,747 $mm^2$. Although FIG. 3 is shown as including a bezel 11, the following calculations are made without the inclusion of a bezel.

To determine the difference in pressure drop between the two second lattice positions, the following formula was used:

$$\Delta p = \frac{k\rho}{2} v^2$$

Wherein p is pressure, k is the minor loss coefficient, ρ is the air density and v is air velocity.

Next, the following equations were solved to determine the difference in pressure drop of air passing through the open area shown in FIG. 1 ($A_2$) as compared to the air passing through the open area shown in FIG. 3 ($A_1$).

$$v = \frac{\dot{V}}{A} \Rightarrow \Delta p = \frac{k\rho}{2}\left(\frac{\dot{V}}{A}\right)^2$$

$$\left(\frac{\Delta p_1}{\Delta p_2}\right) = \frac{A_2^2}{A_1^2}$$

$$\frac{\Delta p_1}{\Delta p_2} = \frac{(3141\ mm^2)^2}{(3747\ mm^2)^2} = 0.703$$

Wherein $\dot{V}$ is constant volume flow and A is area.

As can be seen, the pressure drop of air passing through the open area shown in FIG. 1 ($A_1$) as compared to the air passing through the open area shown in FIG. 3 ($A_2$) is about 70.3%. This pressure drop is indicative of an increased airflow when the second lattice 4 of fan guard 1 is in the first position shown in FIG. 3. Due to a decrease in pressure, fan speeds can be decreased to achieve a similar air flow to the flow when the second lattice 4 is in the alternate position. This reduction in fan speed can reduce overall noise of a fan, reduce energy consumption of the fan, and prolong the life of the fan.

Example 2

Figure 17:
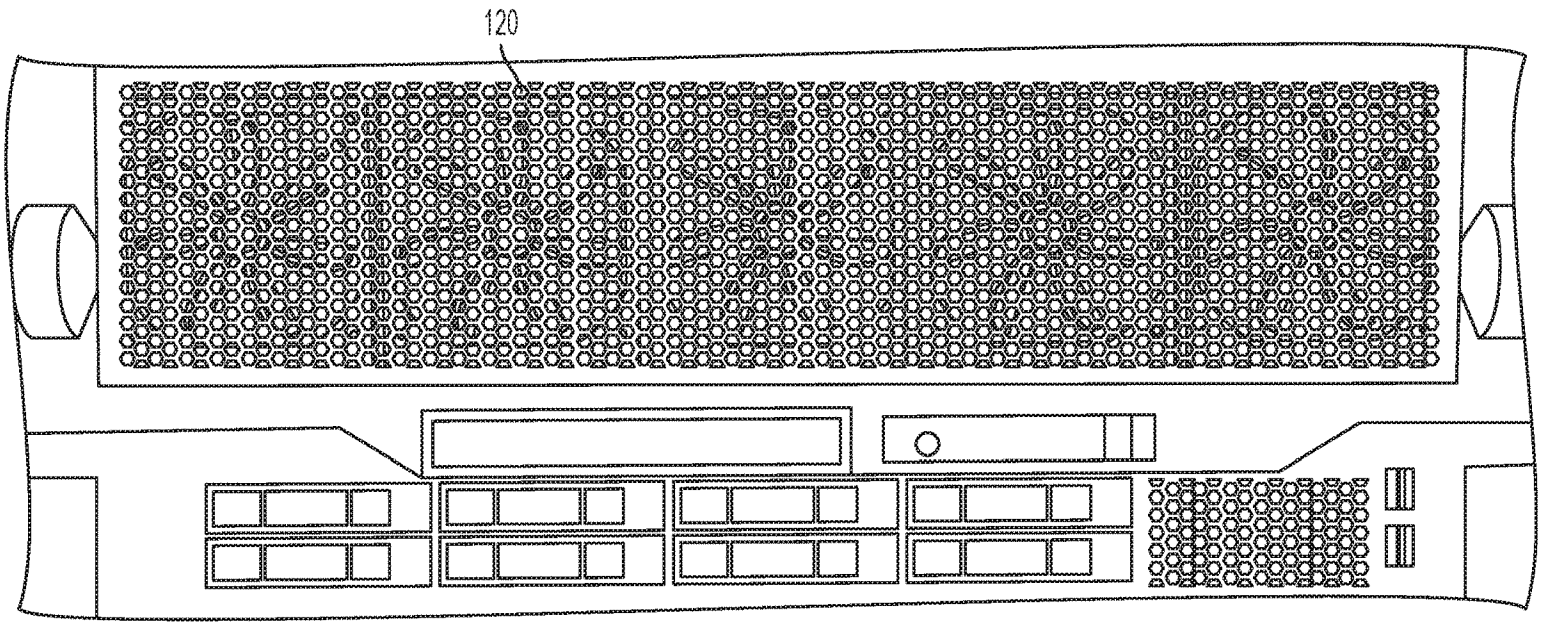
FIG. 17 is a front view of fan assemblies that can be used in conjunction with the fan guards of the present disclosure covered by a bezel.

A front view of five individual fan assemblies, which can be used in conjunction with the fan guards described above, is shown in FIG. 17. In FIG. 17, a bezel 120 (honeycomb structure) is shown as covering five fan assemblies and separates the fan blades of each fan assembly from where the user can access the covered fan blades. With the bezel 120 installed, the fan guard would be in the state shown in FIGS. 3 and 12. This bezel 120 can be composed of features shown on bezels 11 and/or 211 as discussed above, including one or more bezel extensions and/or central areas to interact with each of the five individual fan assemblies. The bezel prevents a user from reaching through the larger fan openings to touch moving fan blades in this configuration.

Figure 18:
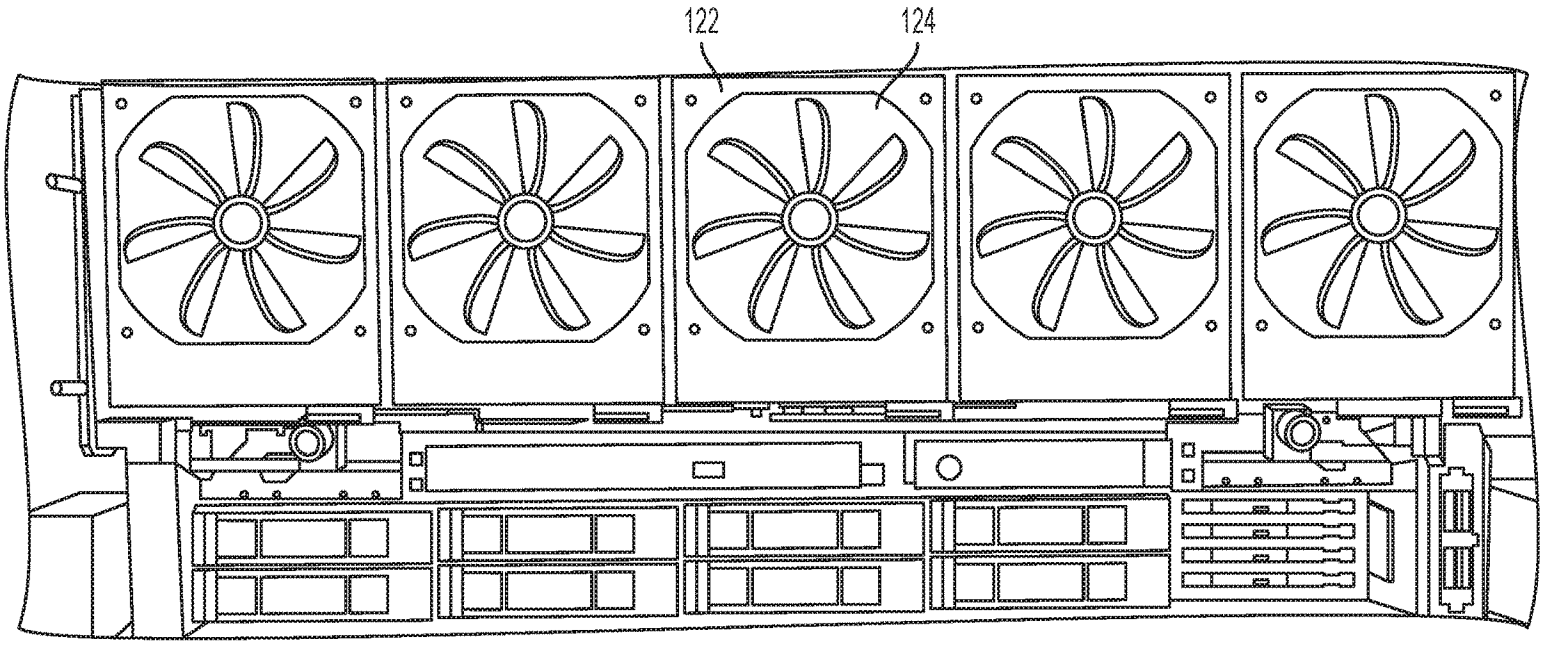
FIG. 18 is a front view of fan assemblies that can be used in conjunction with the fan guards of the present disclosure not covered by a bezel.

A front view of the five individual fan assemblies of FIG. 17 are shown again in FIG. 18, with the bezel 120 removed, resulting in the fan guard being placed in the state shown in FIGS. 1 and 10.

In this view each fan assembly includes a barrier 122, which is between where the user can access and the fan blades 124. In embodiments of the present disclosure, each of these barriers 122 can be removed and replaced with the fan guard 1 or fan guard 201 as described above.

While the present application has been particularly shown and described with respect to preferred embodiments thereof, it will be understood by those skilled in the art that the foregoing and other changes in forms and details may be made without departing from the spirit and scope of the present application. It is therefore intended that the present application not be limited to the exact forms and details described and illustrated, but fall within the scope of the appended claims.

What is claimed is:

1. A fan apparatus comprising:

a fan guard, the fan guard comprising:

a first lattice, the first lattice comprising a first lattice protrusion;

a second lattice, the second lattice comprising a second lattice protrusion and an inclined portion;

a catch;

a tensioning element, a first end of the tensioning element operably attached to the first lattice protrusion, a second end of the tensioning element operably attached to the second lattice protrusion, the tensioning element applying a rotational force to the second lattice in a first direction;

a bezel, the bezel comprising:

a bezel extension that extends substantially perpendicularly from a face of the bezel, wherein the bezel extension is configured to rotate the catch; and an inclined plane extending from the face of the bezel, the inclined plane configured to contact the inclined portion of the second lattice and configured to apply a rotational force to the second lattice in a second direction, moving the second lattice from an alternate position to a first position.

2. The fan apparatus of claim 1, wherein crosspieces of the first lattice substantially align with crosspieces of the second lattice when the second lattice is in the first position.

3. The fan apparatus of claim 1, wherein when the second lattice is in the first position, openings between crosspieces of the first lattice and openings between crosspieces of the second lattice are larger than the area proscribed in IEC 60950.

4. The fan apparatus of claim 3, wherein when the second lattice is in the first position, openings in the bezel are smaller than or equal to the area proscribed in IEC 60950.

5. The fan apparatus of claim 1, wherein when the second lattice is in the alternate position, openings between crosspieces of the first lattice and openings between crosspieces of the second lattice are smaller than or equal to the area proscribed in IEC 60950.

6. The fan apparatus of claim 1, wherein the bezel extension is configured to rotate the catch and contact the catch.

7. The fan apparatus of claim 1, wherein the second lattice further comprises a second lattice extension extending from a surface of the second lattice.

8. The fan apparatus of claim 1, wherein the bezel further comprises a bezel protrusion that extends from the face of the bezel.

9. The fan apparatus of claim 8, wherein the bezel protrusion is configured to contact the second lattice when second lattice is in the first position.

10. The fan apparatus of claim 1, wherein the bezel extension extends a distance further from the face of the bezel than the inclined plane.

11. The fan apparatus of claim 10, wherein the bezel extension is configured to rotate the catch prior to contact between the inclined plane and inclined portion.

12. A fan apparatus comprising:

a fan guard, the fan guard comprising:

a first lattice, the first lattice comprising a first lattice protrusion;

a second lattice, the second lattice comprising a second lattice protrusion and a second lattice projection;

a catch;

a tensioning element, a first end of the tensioning element operably attached to the first lattice protrusion, a second end of the tensioning element operably attached to the second lattice protrusion, the tensioning element applying a rotational force to the second lattice in a first direction;

a scissor arm, a first end of the scissor arm operably attached to the first lattice, a second end of the scissor arm operably attached to the second lattice projection; and a bezel, the bezel comprising:

a first bezel extension that extends substantially perpendicularly from a face of the bezel, wherein the first bezel extension is configured to rotate the catch; and a second bezel extension that extends substantially perpendicularly from the face of the bezel, wherein the second bezel extension is configured to rotate a portion of the scissor arm, the second bezel extension is configured to contact and rotate an angled portion of the scissor arm to apply a rotational force to the second lattice in a second direction, moving the second lattice from an alternate position to a first position.

13. The fan apparatus of claim 12, wherein crosspieces of the first lattice substantially align with crosspieces of the second lattice when the second lattice is in the first position.

14. The fan apparatus of claim 12, wherein when the second lattice is in the first position, openings between crosspieces of the first lattice and openings between crosspieces of the second lattice are larger than the area proscribed in IEC 60950.

15. The fan apparatus of claim 14, wherein when the second lattice is in the first position, openings in the bezel are smaller than or equal to the area proscribed in IEC 60950.

16. The fan apparatus of claim 12, wherein when the second lattice is in the alternate position, openings between crosspieces of the first lattice and openings between crosspieces of the second lattice are smaller than or equal to the area proscribed in IEC 60950.

17. The fan apparatus of claim 12, wherein the first bezel extension is configured to rotate the catch and contact the catch.

18. The fan apparatus of claim 12, wherein the second bezel extension extends a distance further from the face of the bezel than the first bezel protrusion.

19. The fan apparatus of claim 17, wherein the first bezel extension is configured to contact and rotate the catch prior to the second bezel extension rotating the scissor arm.

20. The fan apparatus of claim 12, wherein the scissor arm is comprised of a plurality of operably connected links that are configured to rotate in reference to one another.

* * * * *